US007305203B2

(12) United States Patent
Sampe et al.

(10) Patent No.: US 7,305,203 B2
(45) Date of Patent: Dec. 4, 2007

(54) IMAGE FORMING APPARATUS INCLUDING A PROCESS CARTRIDGE FORMED WITH A HOLE

(75) Inventors: Atsushi Sampe, Kanagawa (JP); Hiroyuki Nagashima, Kanagawa (JP); Yoshiyuki Kimura, Tokyo (JP); Nobuo Kuwabara, Kanagawa (JP); Hiroshi Hosokawa, Kanagawa (JP); Hideki Zemba, Kanagawa (JP); Wakako Murakami, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 209 days.

(21) Appl. No.: 11/106,435

(22) Filed: Apr. 15, 2005

(65) Prior Publication Data

US 2005/0238384 A1 Oct. 27, 2005

(30) Foreign Application Priority Data

Apr. 26, 2004 (JP) ..... 2004-130412

(51) Int. Cl.
*G03G 21/18* (2006.01)
*G03G 15/01* (2006.01)
*G03G 21/00* (2006.01)

(52) U.S. Cl. ..... 399/111; 399/299; 399/302; 399/346; 399/358

(58) Field of Classification Search ..... 399/111, 399/298, 299, 302, 303, 346, 358, 360
See application file for complete search history.

(56) References Cited

U.S. PATENT DOCUMENTS 4,875,063 A 10/1989 Idenawa et al.
7,024,133 B2 * 4/2006 Nagashima et al. ..... 399/111
7,136,610 B2 * 11/2006 Arai et al. ..... 399/111
2004/0042822 A1 3/2004 Fujishiro et al.
2005/0025520 A1 2/2005 Murakami et al.

FOREIGN PATENT DOCUMENTS

| | | |
|---|---|---|
| EP | 0 341 667 A3 | 11/1989 |
| EP | 1 331 525 A2 | 7/2003 |
| JP | 03-101757 | 4/1991 |
| JP | 08-006385 | 1/1996 |
| JP | 8-202226 | 8/1996 |
| JP | 2000-075745 | 3/2000 |

(Continued)

OTHER PUBLICATIONS

U.S. Appl. No. 11/287,305, filed Nov. 28, 2005, Hosokawa et al.

(Continued)

*Primary Examiner*—William J. Royer
(74) *Attorney, Agent, or Firm*—Oblon, Spivak, McClelland, Maier & Neustadt, P.C.

(57) ABSTRACT

An image forming apparatus includes at least one process cartridge removably mounted on an apparatus body and including at least an image carrier on which a toner image is to be formed and a cleaning device configured to remove toner left after image transfer with a cleaning blade. A hole for passing a light beam emitted from an optical writing unit toward the image carrier therethrough is formed in part of a case bottom wall of the process cartridge higher in level than part of the case bottom wall below the cleaning blade.

7 Claims, 9 Drawing Sheets

FOREIGN PATENT DOCUMENTS

| | | |
|---|---|---|
| JP | 2001-228774 | 8/2001 |
| JP | 2002-62711 | 2/2002 |
| JP | 2003-149995 | 5/2003 |
| JP | 2003-316107 | 11/2003 |
| JP | 2004-117386 | 4/2004 |

OTHER PUBLICATIONS

U.S. Appl. No. 11,372,142, filed Mar. 10, 2006, Zemba.

U.S. Appl. No. 11/679,010, filed Feb. 26, 2007, Arai et al.

* cited by examiner

IMAGE FORMING APPARATUS INCLUDING A PROCESS CARTRIDGE FORMED WITH A HOLE

BACKGROUND OF THE INVENTION

1. Field of the Invention

The present invention relates to an electrophotographic copier, printer, facsimile apparatus, multifunction machine having at least two functions thereof or similar image forming apparatus. More particularly, the present invention relates to an image forming apparatus of the type including a process cartridge, which includes at least an image carrier on which a toner image is to be formed and a cleaning device including a cleaning member for removing toner left on the image carrier after the transfer of the toner image, and removably mounted on the body of the apparatus. A case included in the process cartridge is formed with a hole to pass a light beam emitted from an optical writing unit toward the image carrier therethrough.

2. Description of the Background Art

An image forming apparatus of the type described is conventional and disclosed in, e.g., Japanese Patent Laid-Open Publication No. 2003-316107. This type of image forming apparatus is configured such that a light beam, issued from an optical writing unit, is incident on an image carrier via a hole formed in the bottom wall of a case included in a process cartridge. The opening, however, is apt to cause toner leaked between a cleaning member and the image carrier to drop on the optical writing unit via the above hole. This part of toner contaminates the optical wiring unit and therefore lowers the quality of a toner image formed on the image carrier.

SUMMARY OF THE INVENTION

It is an object of the present invention to provide an image forming apparatus capable of solving the problem described above.

An image forming apparatus of the present invention includes an apparatus body and an image carrier on which a toner image is to be formed. A cleaning device is constructed integrally with the image carrier and includes a cleaning member configured to remove a residual toner left on the image carrier after the transfer of the toner image. At least one wall formed with a hole that allows a light beam emitted from an optical writing unit to be incident on the image carrier therethrough. When the process cartridge is mounted to the apparatus body, the above hole is positioned in the portion of the case bottom wall at a higher level than the portion of the case bottom wall below the cleaning member.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
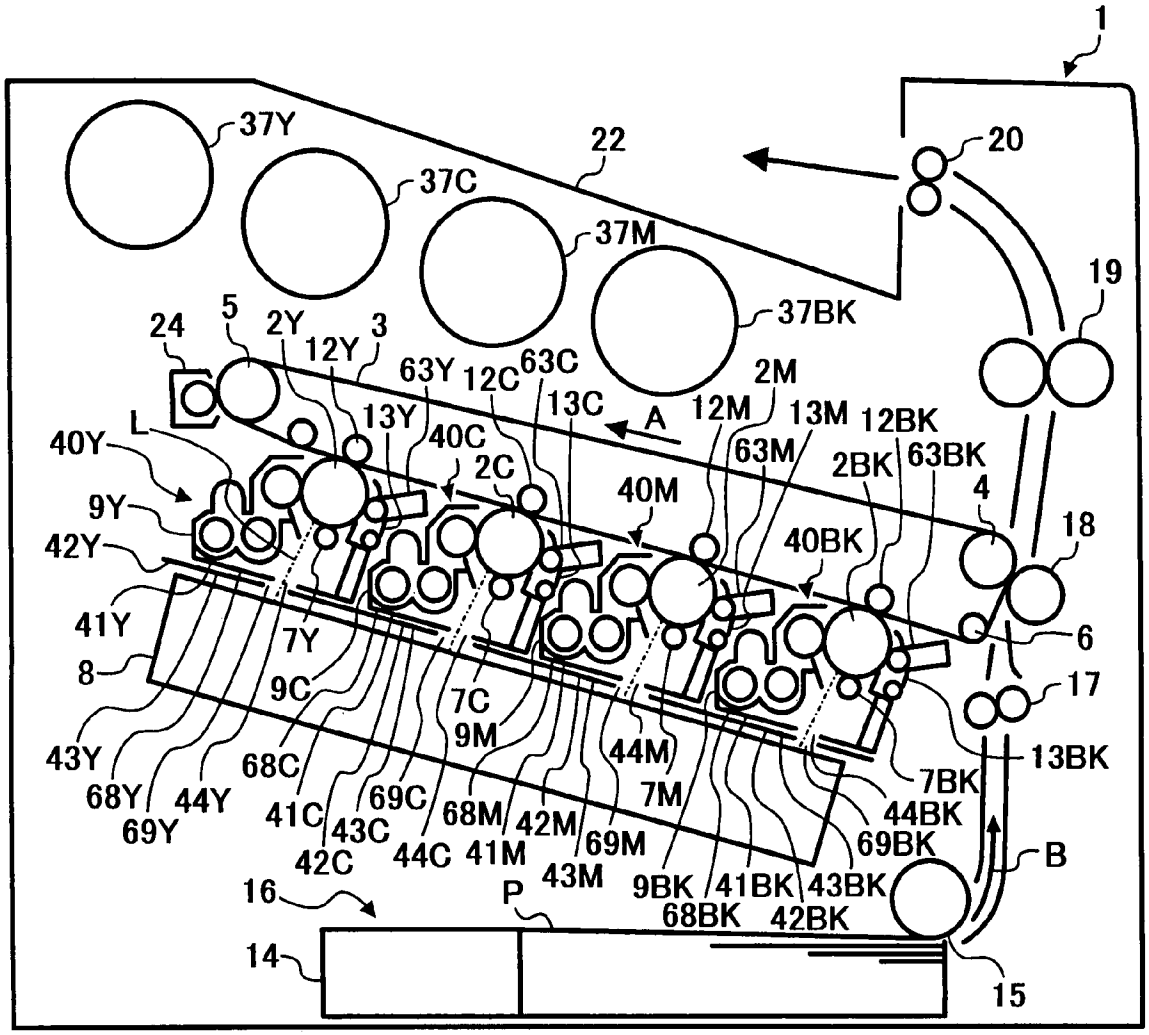
FIG. 1 is a section view showing an image forming apparatus embodying the present invention.

Referring to FIG. 1 of the drawings, an image forming apparatus embodying the present invention is shown in a vertical section and implemented as a full-color image forming apparatus by way of example. As shown, the image forming apparatus includes a first, a second, a third and a fourth photoconductive drum or image carrier 2Y (yellow), 2C (cyan), 2M (magenta) and 2BK (black) arranged in the body 1 of the apparatus and an endless intermediate image transfer belt 3 also disposed in the apparatus body 1. The intermediate image transfer belt (simply belt hereinafter) 3 is passed over support rollers 4, 5 and 6 and caused to turn in a direction indicated by an arrow A in FIG. 1. A toner image of a particular color is formed on each of the drums 2Y, 2C, 2M, and 2BK. The belt 3 is positioned above the drums 2Y, 2C, 2M, and 2BK with its lower run contacting the circumferences of the drums 2Y, 2C, 2M, and 2BK. It is to be noted that the belt 3 is a specific form of an image transfer member to which toner images are to be transferred from the drums 2Y, 2C, 2M, and 2BK.

Arrangements for forming toner images on the drums 2Y, 2C, 2M, and 2BK and transferring the toner images to the belt 3 all are substantially identical except for the color of toner. Therefore, the following description will concentrate on arrangements for forming a yellow toner image on the first drum 2Y and transferring it to the belt 3 by way of example.

Figure 2:
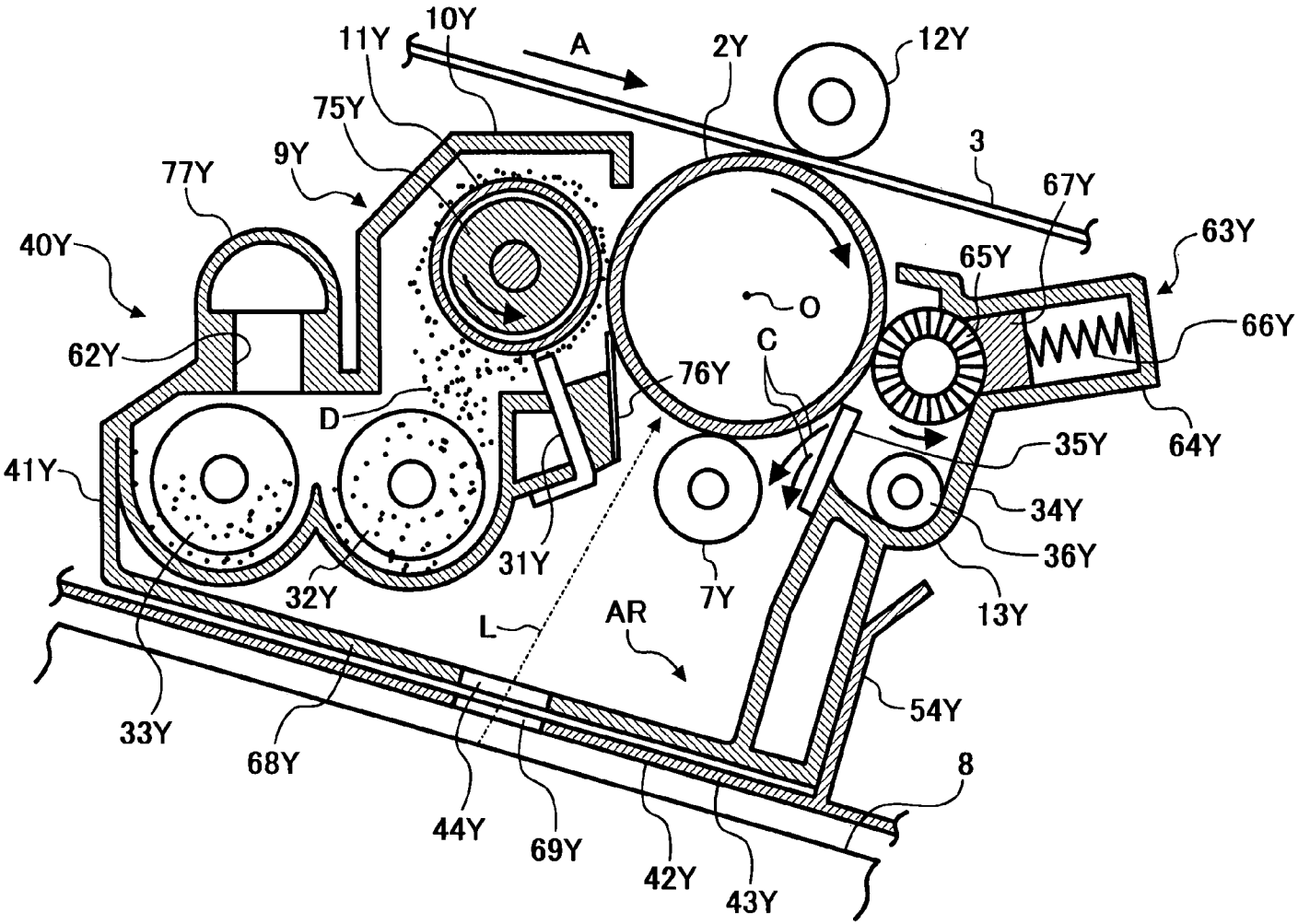
FIG. 2 is an enlarged section view showing a first image carrier included in the illustrative embodiment together with image forming devices arranged therearound.

FIG. 2 shows image forming devices configured to form a toner image on the surface of the drum 2Y in an enlarged view. As shown, while the drum 2Y is rotated clockwise, as viewed in FIG. 2, a charge roller or charger 7Y to which a charge voltage is applied uniformly charges the surface of the drum 2Y to a preselected polarity. Subsequently, a light beam L, issued from an optical writing unit 8 and modulated in accordance with image data, is incident on the charged surface of the drum 2Y, forming a latent image on the drum 2Y. In the illustrative embodiment, the light beam L is implemented as a laser beam. The latent image thus formed on the drum 2Y is developed by a developing device 9Y to become a yellow toner image.

The developing device 9Y includes a case 10Y storing a dry yellow developer D therein. A developing roller 11Y is formed of aluminum and positioned in the vicinity of the drum 2Y to face the drum 2Y via an opening formed in the case 10Y. A magnet roller 75Y is disposed in the developing roller 11Y while a doctor blade 31Y limits, or meters, the amount of the developer existing on the developing roller 11Y. The developing device 9Y additionally includes screws 32Y and 33Y facing the developing roller 11Y and a seal member 76Y.

The developer D present in the case 10Y is conveyed by the screws 32Y and 33Y while being agitated thereby and then deposited on the developing roller 11Y, which is being rotated counterclockwise in FIG. 2, by the magnetic force of the magnet roller 75Y. The doctor blade 31Y meters the developer D thus deposited on the developing roller 11Y to thereby regulate the height of the developer D. When the developer D thus metered is conveyed by the developing roller 11Y to a developing zone between the developing roller 11Y and the drum 2Y, toner in the developer D is electrostatically transferred to a latent image formed on the drum 2Y, thereby producing a corresponding toner image. While the illustrative embodiment is practicable with either one of a single-component developer or toner and a two-component developer or toner and carrier mixture, it is assumed to use the two-component developer by way of example. At the time of development, the developing roller 11Y is rotated by an apparatus body gear, not shown, at a linear velocity two and half times as high as the drum 2Y in the forward direction. The seal member 76Y is positioned upstream of the developing roller 11Y in the direction of rotation of the drum 2Y in order to prevent the toner image from dropping.

A primary image transfer roller 12Y is positioned on the opposite side to the drum 2Y with respect to the belt 3. When an image transfer voltage is applied to the primary image transfer roller 12Y, the toner image is transferred from the drum 2Y to the belt 3 turning in the direction A. This image transfer will be referred to as primary image transfer hereinafter. Residual toner left on the drum 2Y after the primary image transfer is removed by a cleaning device 13Y.

In the illustrative embodiment, the cleaning device 13Y includes a case 34Y formed with an opening that faces the drum 2Y. A cleaning blade 35Y is affixed to the case 34Y at one edge and pressed against the surface of the drum 2Y at the other edge for removing toner left on the drum 2Y after the primary image transfer. A screw 36Y conveys the toner thus removed to a waste toner bottle not shown. The charge roller 7Y is applied with an AC-biased DC voltage and therefore charges the drum 2Y at the same time as it discharges the drum 2Y when the drum 2Y, cleaned by the cleaning device 13Y, passes by the charge roller 7Y. Consequently, the drum 2Y is prepared for the next image formation.

The cleaning blade 35Y is a specific form of a cleaning member for removing toner left on an image carrier after the transfer of a toner image. Also, the screw 36Y is a specific form of toner conveying means for conveying the toner thus removed by the cleaning member to the outside of the apparatus.

A cyan, a magenta and a black toner image are respectively formed on the second, third and fourth drums 2C, 2M and 2BK in exactly the same manner as the yellow toner image formed on the first drum 2Y and sequentially transferred to the belt 3 over the yellow toner image by primary image transfer, completing a composite color image on the belt 3. Toner left on each of the drums 2C, 2M, and 2BK after the primary image transfer is removed by a respective cleaning device like the toner left on the drum 2Y.

As shown in FIG. 1, while image forming devices identical in function with those arranged around the first drum 2Y are disposed around the second to fourth image carriers 2C, 2M, and 2BK, such image forming devices are simply distinguished from the image forming device around the drum 2Y by suffixes C, M and BK.

Referring again to FIG. 1, a sheet cassette 14 loaded with paper sheets or similar recording media P and a sheet feeding device 16 including a pickup roller 15 are arranged in the lower portion of the apparatus body 1. The pickup roller 15 pays out the top paper sheet from the sheet cassette 14 in a direction indicated by an arrow B in FIG. 1 when rotated. The paper sheet P is then conveyed by a registration roller pair 17 toward part of the belt 3 passed over the support roller 4 and a secondary image transfer roller 18 facing it at preselected timing. At this instant, a preselected image transfer voltage is applied to the secondary image transfer roller 18, so that the composite color image is transferred from the belt 3 to the paper sheet P. Let this image transfer be referred to as secondary image transfer as distinguished from the primary image transfer.

The paper sheet P, thus carrying the composite color image thereon, is conveyed further upward to a fixing device 19, which fixes the color image on the paper sheet P with heat and pressure. Subsequently, the paper sheet P is driven out of the apparatus body 1 by an outlet roller pair 20 to a stack portion 22 formed on the top of the apparatus body 1. Toner left on the belt 3 after the secondary image transfer is removed by a cleaning device 24.

Toner bottles 37Y, 37C, 37M and 37BK storing yellow toner, cyan toner, magenta toner and black toner, respectively, are removably mounted to the upper portion of the apparatus body 1. The yellow toner, cyan toner, magenta toner and black toner are respectively replenished from the toner bottles 37Y, 37C, 37M, and 37BK to developing devices 9Y, 9C, 9M and 9BK via respective paths. More specifically, as shown in FIG. 2, a dome-like toner guide member 77Y is affixed to the top wall of the case 10Y. The yellow toner is fed from the toner bottle 37Y to the toner guide member 77Y via a pipe, not shown, and then replenished to the rear portion of the case 10Y, as viewed in FIG. 2, via a toner inlet 62Y formed in the top wall of the case 10Y. The toner thus replenished to the case 10Y is conveyed by the screw 33Y from the rear toward the front, as viewed in FIG. 2, and then conveyed by the screw 32Y from the front toward the rear. At this instant, the toner and carrier are agitated together, and each is frictionally electrified to a particular polarity. This is also true with the other developing devices 9C, 9M and 9BK.

As shown in FIG. 1, lubricant coating devices 63Y, 63C, 63M and 63BK respectively face the drums 2Y, 2C, 2M, and 2BK in order to coat them with a lubricant. More specifically, as shown in FIG. 2, the lubricant coating device 63Y, for example, faces the drum 2Y and is made up of a case 64Y, a brush roller 65Y supported by the case 64Y and rotatable counterclockwise, as seen in FIG. 2, and a solid lubricant 67Y pressed against the brush roller 65Y by a spring 66Y. The brush roller 65Y is caused to rotate in contact with the surface of the drum 2Y while shaving off the lubricant 67Y in the form of powder and coating it on the drum 2Y. The lubricant 67Y may be implemented by zinc stearate or calcium stearate by way of example.

More specifically, the brush roller 65Y is made up of a grounded metallic core and bristles made of acrylic conductive resin SA-7 6.25D/F (trade name) available from Toray and provided with density of 50,000/in$^2$. The lubricant 67Y is pressed against the brush roller 65Y with a pressure of 500 mN to 2,000 mN. The brush roller 65Y is rotated in the same direction as the drum 2Y, as seen at their contact point, at a linear velocity 1 time to 1.3 times as high as the drum 2Y. The drum 2Y and brush roller 65Y have diameters of, e.g., 30 mm and 12 mm, respectively. The brush roller 65Y bites into the drum 2Y by 1 mm. The other lubricant coating devices 63C, 63M and 63BK are identical in configuration with the lubricant coating device 63Y.

Should the coefficient of friction of the surface of the drum or image carrier become unstable, the cleaning blade would fail to fully clean the drum. In this respect, the lubricant, coated on each drum, is capable of stabilizing the cleaning ability of the cleaning blade for thereby extending the life of the drum.

In the illustrative embodiment, the drum 2Y, charge roller or charger 7Y, developing device 9Y, lubricant coating device 63Y and cleaning device 13Y are constructed into a single process cartridge 40Y. More specifically, the cases 10Y, 64Y and 34Y are configured as a single unit case 41Y while the drum 2Y and charge roller 7Y are rotatably supported by the unit case 41Y. The drum 2Y, developing device 9Y, cleaning device 13Y, charge roller 7Y and lubricant coating device 63Y are constructed into the process cartridge 40Y. Likewise, the other drums 2C, 2M and 2BK and image forming devices arranged therearound are constructed into process cartridges 40C, 40M and 40BK. The process cartridges 40Y, 40C, 40M, and 40BK each are removably mounted to the apparatus body 1 in the direction perpendicular to the sheet surface of FIG. 1 or 2.

While the drum or image carrier, charger, developing device, lubricant coating device and cleaning device all are constructed into a single process cartridge in the illustrative embodiment, the crux is that at least the drum and cleaning device be constructed into a process cartridge. More specifically, the drum on which a toner image is to be formed and the cleaning device including a cleaning member configured to remove toner left on the drum after image transfer are constructed integrally with each other. Such a process cartridge is removably mounted to the apparatus body 1.

As shown in FIG. 1, the belt 3 is inclined downward from the left to the right while the drums 2Y, 2C, 2M, and 2BK are arranged side by side along the lower run of the belt 3. The process cartridges 40Y, 40C, 40M, and 40BK are also arranged side by side in correspondence to the drums 2Y, 2C, 2M, and 2BK, respectively, and inclined at an angle relative to a horizontal plane. In the illustrative embodiment, the process cartridges 40Y, 40C, 40M, and 40BK and the lower run of the belt 3 which they face are inclined by an angle of about 15° relative to a horizontal plane.

Figure 3:
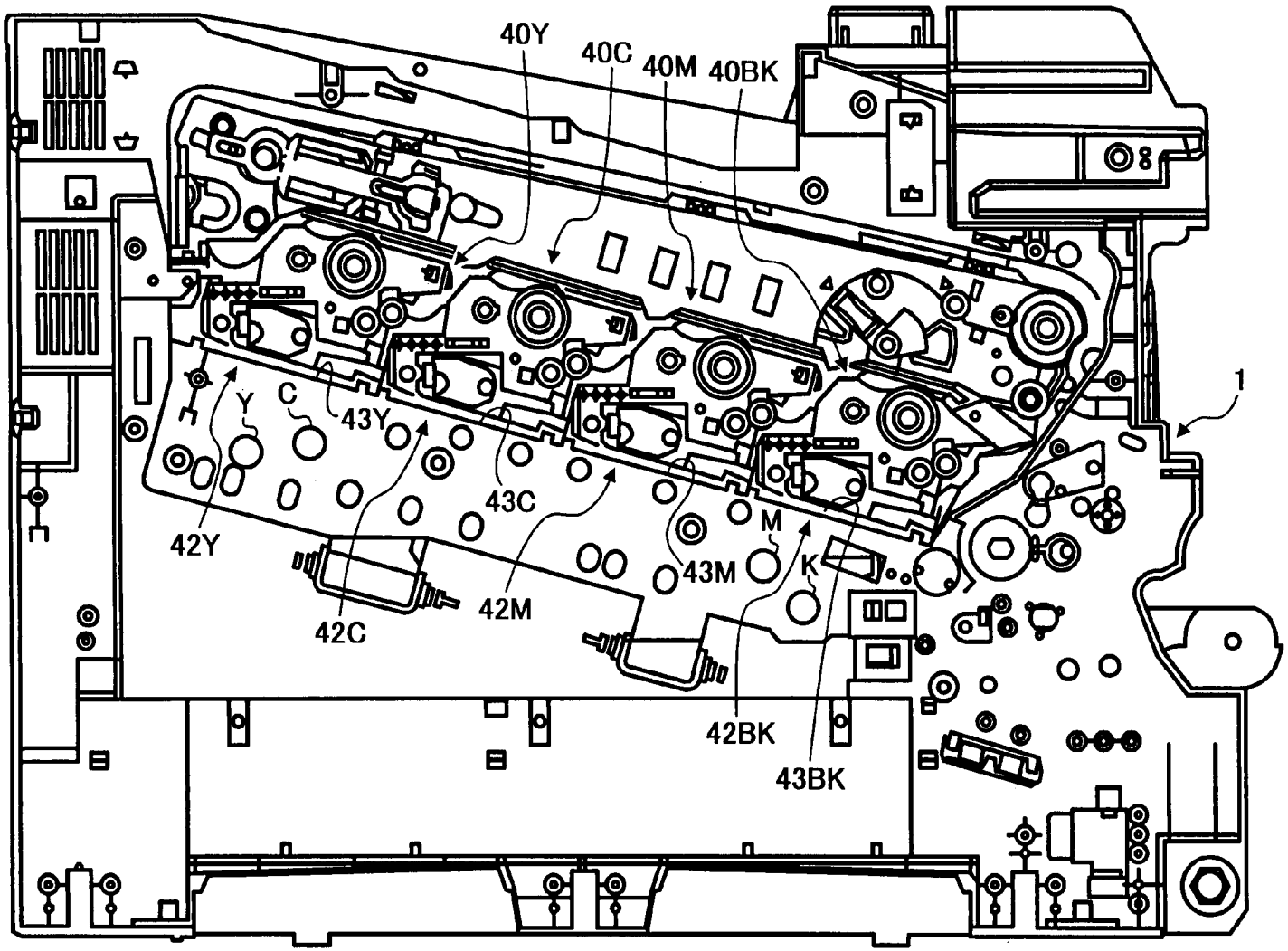
FIG. 3 is a section view showing the apparatus body of the illustrative embodiment loaded with process cartridges.
Figure 4:
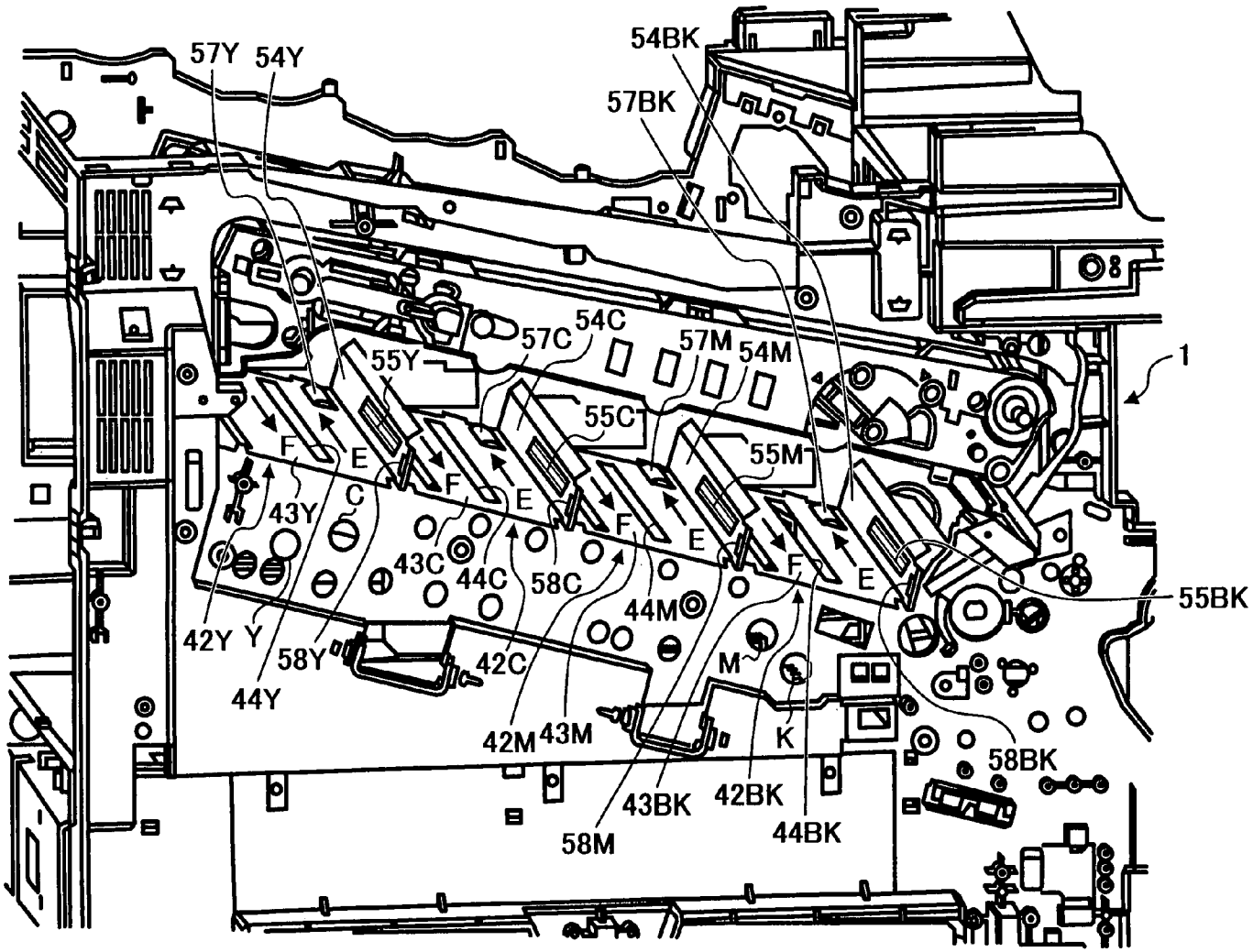
FIG. 4 is a section view showing the apparatus body not loaded with the process cartridges.

FIG. 3 is a front view showing the intermediate image transfer belt 3 accommodated in a case and showing the process cartridges 40Y, 40C, 40M, and 40BK. FIG. 4 is a view showing the apparatus body 1 from which the process cartridges 40Y, 40C, 40M, and 40BK are removed. As shown in FIG. 4, guides 42Y, 42C, 42M and 42BK are affixed to the apparatus body 1 and respectively include support plates 43Y, 43C, 43M and 43BK and stop plates 54Y, 54C, 54M and 54BK, not shown in FIG. 1, rising substantially vertically from the support plates 43Y, 43C, 43M, and 43BK, respectively. The support plates 43Y, 43C, 43M, and 43BK respectively guide the bottoms of the process cartridges 40Y, 40C, 40M, and 40BK when the process cartridges 40Y, 40C, 40M, and 40BK are mounted or dismounted to or from the apparatus body 1. The support plates 43Y, 43C, 43M, and 43BK each are inclined substantially in parallel to the lower run of the belt 3 which the drums 2Y, 2C, 2M, and 2BK face. In the illustrative embodiment, the support plates 43Y, 43C, 43M, and 43BK each are inclined by 15° relative to a horizontal plane.

As shown in FIGS. 1 and 2, the unit cases 41Y, 41C, 41M, and 41BK of the process cartridges 40Y, 40C, 40M, and 40BK, respectively, include bottom walls 68Y, 68C, 68M and 68BK, respectively, which are inclined in parallel to the support plates 43Y, 43C, 43M, and 43BK, so that the process cartridges 40Y, 40C, 40M, and 40BK can be mounted to the apparatus body 1 in an inclined position, as stated previously. Holes 44Y, 44C, 44M and 44BK and holes 69Y, 69C, 69M and 69 BK are respectively formed in the support plates 43Y, 43C, 43M, and 43BK and the bottle walls 68Y, 68C, 68M, and 68BK of the process cartridges 40Y, 40C, 40M, and 40BK, allowing the laser beams L emitted from the optical writing unit 8 to be incident on the drums 2Y, 2C, 2M, and 2BK.

The process cartridges 40Y, 40C, 40M, and 40BK each are mounted to the apparatus body 1 in a direction indicated by an arrow E in FIG. 4 and dismounted from the same in a direction indicated by an arrow F. At this instant, the bottom walls 68Y, 68C, 68M, and 68BK of the process cartridges 40Y, 40C, 40M, and 40BK are respectively guided by the support plates 43Y, 43C, 43M, and 43BK. At the same time, the side walls of the unit cases 41Y, 41C, 41M, and 41BK are respectively abutted against the stop plates 54Y, 54C, 54M, and 54BK due to the weights of the process cartridges 40Y, 40C, 40M, and 40BK, see FIG. 7. In this manner, the process cartridges 40Y, 40C, 40M, and 40BK are smoothly mounted to or dismounted from the apparatus body 1 by being protected from widthwise shift by the guides 42Y, 42C, 42M, and 42BK, respectively. It is to be noted that the widthwise direction of each process cartridge 40Y, 40C, 40M, and 40BK refers to a direction W, see FIG. 6, perpendicular to the lengthwise direction LL of the process cartridge 40Y, 40C, 40M, and 40BK.

As shown in FIG. 2, although the cleaning blade 35Y of the cleaning device 13Y, for example, is held in contact with the surface of the drum 2Y, an extremely small amount of toner generally leaks between the cleaning blade 35Y and the surface of the drum 2Y, as indicated by an arrow C. If such part of toner drops on the optical writing unit 8 via the holes 44Y and 69Y, then it smears the optical writing unit 8 and therefore lowers the quality of a toner image formed on the drum 2Y.

By contrast, as shown in FIG. 2, the illustrative embodiment is configured such that in the condition wherein the process cartridge 40Y, for example, is set on the apparatus body 1, the holes 44Y and 69Y are positioned at a higher level than the wall portion AR of the case below the cleaning blade or cleaning member 35Y. More specifically, in the illustrative embodiment, the hole 44Y of the case bottom wall 68Y and support plate 43Y each are inclined relative to a horizontal plane, as stated previously. Consequently, the holes 44Y and 69Y are positioned at a higher level than the bottom portion AR of the case below the cleaning blade 35Y.

Figure 6:
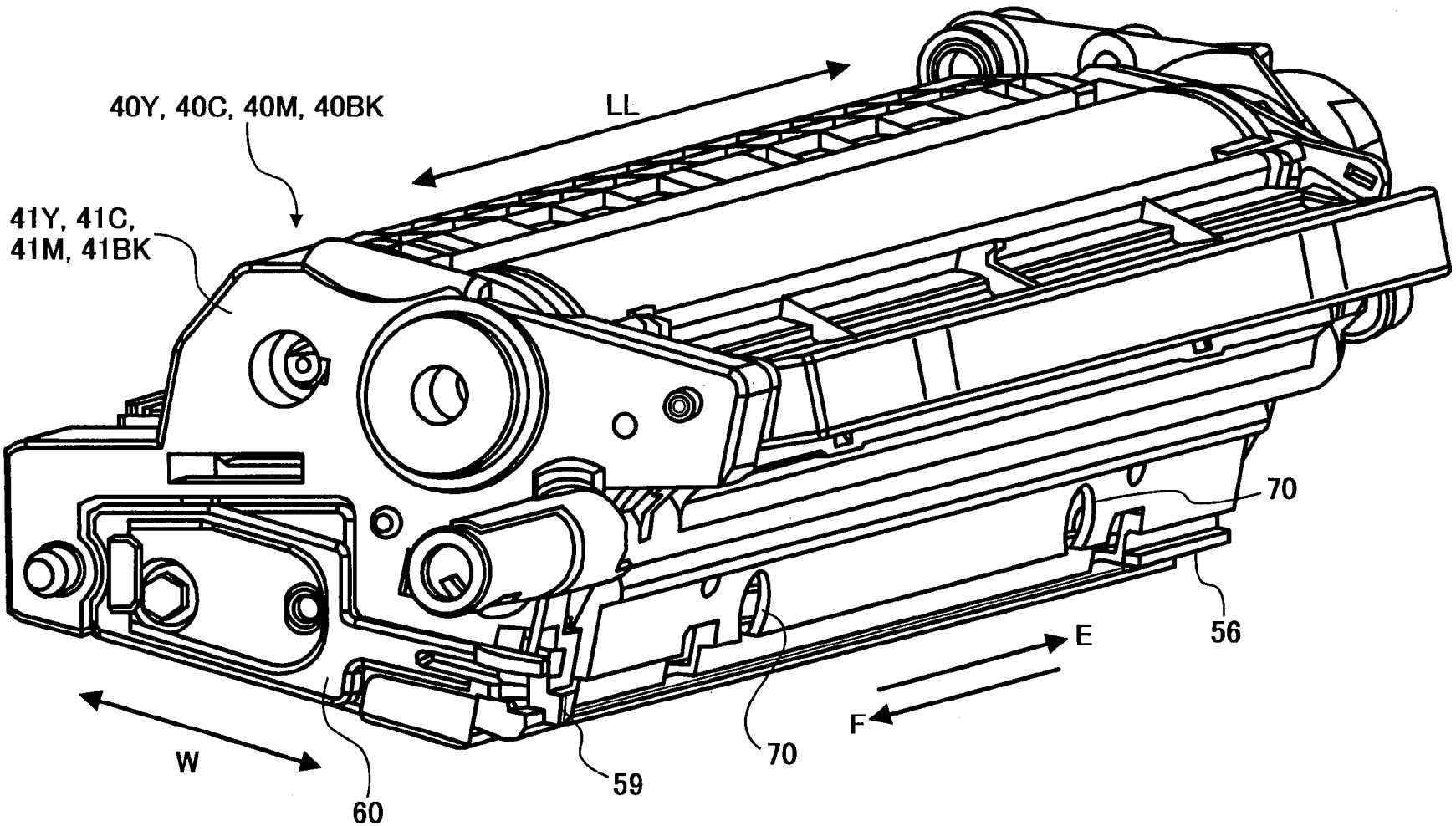
FIG. 6 is an isometric view showing the process cartridge included in the illustrative embodiment.

In the configuration stated above, even if the toner leaks between the cleaning member 35Y and the drum or image carrier 2Y, it stays on the bottom wall portion AR lower in level than the holes 44Y and 69Y and does not move to the holes 44Y and 69Y higher in level than the bottom wall portion AR. Further, as shown in FIG. 6, when through holes 70 are formed in the unit case 41Y, 41C, 41M, and 41BK of the process cartridge 40Y, 40C, 40M, and 40BK, the toner dropped on the case bottom wall portion AR goes out via the holes 70, but is received by the guides 42Y and prevented from dropping on the optical writing unit 8. This is also true with the other process cartridges 40C, 40M and 40BK.

The cleaning device 13Y further includes a waste toner screw or toner conveying means 36Y configured to convey the toner removed from the drum 2Y by the cleaning blade or cleaning member 35Y to the outside of the cleaning device 13Y. This toner conveying means 36Y is positioned below the axis O of the drum or image carrier 2Y, so that the toner is conveyed by the waste toner screw 36Y at a side remote from the drum 2Y and charge roller 7Y. This prevents the toner from being scattered toward the drum 2Y or the charge roller 7Y. The other process cartridges 40C, 40M and 40BK are configured in exactly the same manner as the process cartridge 40Y.

The developing device 9Y, also included in the process cartridge 40Y of the illustrative embodiment, is located at the opposite side to the cleaning device 13Y with respect to the drum 2Y. Further, as shown in FIG. 2, the developing roller 11Y of the developing device 9Y is rotated in such a direction as to convey the developer D upward at the position where the developing roller 11Y faces the drum 2Y. In addition, the drum 2Y moves in the same direction as the developing roller 11Y at the position where the former faces the latter. This is also true with the other process cartridges 40C, 40M and 40BK. Thus, the developing roller 11Y, conveying the developer upward, prevents the carrier or the toner of the developer from moving into or out of the process cartridge 40Y, thereby protecting the inside of the process cartridge 40Y and that of the apparatus from smears.

In the illustrative embodiment, a plurality of process cartridges 40Y, 40C, 40M, and 40BK are arranged side by side, and each is inclined relative to a horizontal plane, as stated earlier. As shown in FIG. 1, paying attention to two adjoining process cartridges, at least part of the cleaning device of the upper process cartridge is positioned above the developing device of the lower process cartridge. Likewise, at least part of the lubricant coating device of the upper process cartridge is positioned above the developing device of the lower process cartridge. For example, as shown in FIG. 1, while the process cartridge 40C is located below the process cartridge 40Y adjoining it, the cleaning device 13Y and lubricant coating device 63Y of the upper process cartridge 40 are positioned above the developing device 9C of the lower process cartridge 40C.

By inclining the process cartridges 40Y, 40C, 40M, and 40BK relative to a horizontal plane, as stated above, it is possible to provide broad spaces above the developing devices of the process cartridges and dispose the cleaning devices and lubricant coating devices in such spaces. This allows the cleaning devices and lubricant coating devices to be increased in size and therefore allows a large lubricant 67Y to be used. Consequently, the lives of the other components of the process cartridge and the life of the lubricant 67Y can be made substantially coincident. For example, an A4 machine can be loaded with a zinc stearate bar sized 8×8×236 mm that extends the life of the process cartridge to more than 100,000 paper sheets. The illustrative embodiment, therefore, solves the problem of a conventional image forming apparatus that because a space wide enough to accommodate a large lubricant is not available, a small lubricant should be used and is used up before the lives of the other parts of the process cartridge end. Moreover, the life of the lubricant and the lives of the other parts of the process cartridge are substantially coincident, so that the process cartridge can be replaced without wasteful cost.

Figure 5:
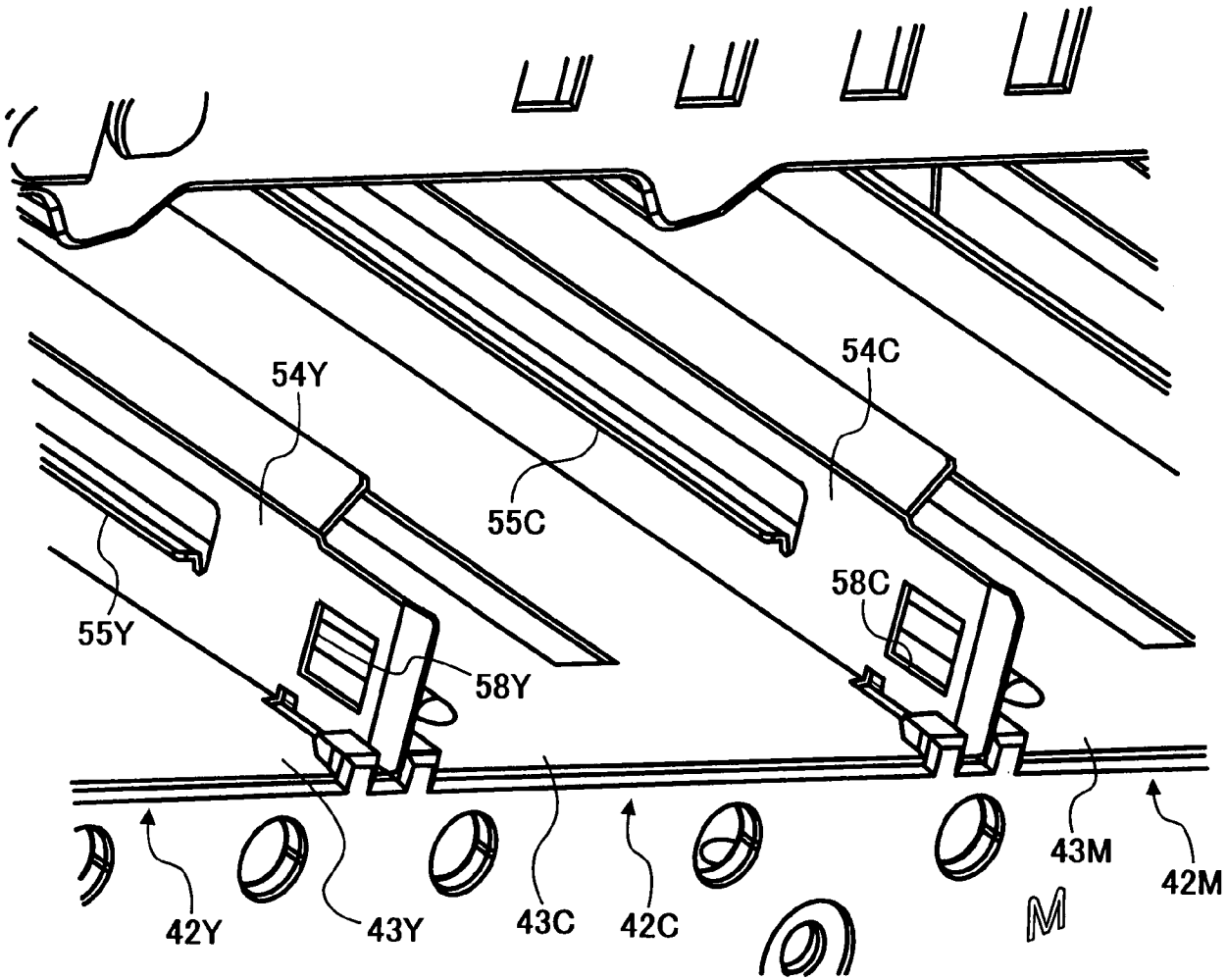
FIG. 5 is a fragmentary enlarged view of the apparatus body shown in FIG. 4.

When any one of the process cartridges 40Y, 40C, 40M, and 40BK is mounted to the apparatus body 1, it is likely that the drum or image carrier 2Y, 2C, 2M, and 2BK of the process cartridge 40Y, 40C, 40M, and 40BK contacts the belt 3, scratching the surface of the belt 3 as well as its own surface. In light of this, as shown in FIGS. 4 and 5, the apparatus body 1 includes guide portions 55Y, 55C, 55M and 55 BK, not shown in FIG. 1 or 2, for restricting the upward movement of the process cartridges 40Y, 40C, 40M, and 40BK. In the illustrative embodiment, the guide portions 55Y, 55C, 55M, and 55BK are formed flat by cutting and raising part of restricting plates 54Y, 54C, 54M, and 54BK, which comprise sheet metal or similar flat materials. The guide portions 55Y, 55C, 55M, and 55BK are spaced upward from the support plates 43Y, 43C, 43M, and 43BK, respectively.

On the other hand, as shown in FIG. 6, the unit cases 41Y, 41C, 41M, and 41BK of the process cartridges 40Y, 40C, 40M, and 40BK, respectively, each are formed with an engaging portion or projection 56 at the front end, i.e., the rear end when the process cartridge 40Y, 40C, 40M, and 40BK is mounted on the apparatus body 1. In this configuration, when any one of the process cartridges 40Y, 40C, 40M, and 40BK is inserted into the apparatus body 1 along associated one of the guides 42Y, 42C, 42M, and 42BK, the engaging portion 56 of the process cartridge 40Y, 40C, 40M, and 40BK contacts the underside of associated one of the guide portions 55Y, 55C, 55M, and 55BK, FIGS. 4 and 5. This is also true when the process cartridge 40Y, 40C, 40M, and 40BK is pulled out of the apparatus body 1. Consequently, the process cartridge 40Y, 40C, 40M, and 40BK is prevented from moving upward and causing its drum 2Y, 2C, 2M, and 2BK from contacting the belt 3 when mounted to the process cartridge, thereby protecting the surface of the drum 2Y, 2C, 2M, and 2BK and that of the belt 3 from scratches.

As shown in FIG. 4, the guide portions 55Y, 55C, 55M, and 55BK are shorter than the support plates 43Y, 43C, 43M, and 43BK in the front-and-rear direction of the apparatus body 1. In this configuration, when the process cartridges 40Y, 40C, 40M, and 40BK are inserted halfway into the apparatus body 1, the engaging portions 56 of the process cartridges 40Y, 40C, 40M, and 40BK get out of the associated guide portions 55Y, 55C, 55M, and 55BK. Therefore, when any one of the process cartridges 40Y, 40C, 40M, and 40BK is inserted into the apparatus body 1 up to a preselected position, it can be shifted upward to bring its drum 2Y, 2C, 2M, and 2BK into contact with the belt 3. In this manner, the guide portions 55Y, 55C, 55M, and 55BK limit the upward movement of the process cartridges 40Y, 40C, 40M, and 40BK, respectively, up to a preselected position in the apparatus body 1.

Further, as shown in FIG. 4, bulges 57Y, 57C, 57M and 57BK respectively rise from the rear portions of the support plates 43Y, 43C, 43M and 43BK. When any one of the process cartridges 40Y, 40C, 40M, and 40BK is inserted into the apparatus body 1, the engaging portion 56 of the process cartridge 40Y, 40C, 40M, and 40BK gets out of associated one of the guide portions 55Y, 55C, 55M, and 55BK, and then the process cartridge 40Y, 40C, 40M, and 40BK gets on associated one of the bulges 57Y, 57C, 57M, and 57BK and is raised thereby with the result that the drum 2Y, 2C, 2M, and 2BK of the process cartridge 40Y, 40C, 40M, and 40BK is caused to contact the belt 3.

Figure 8:
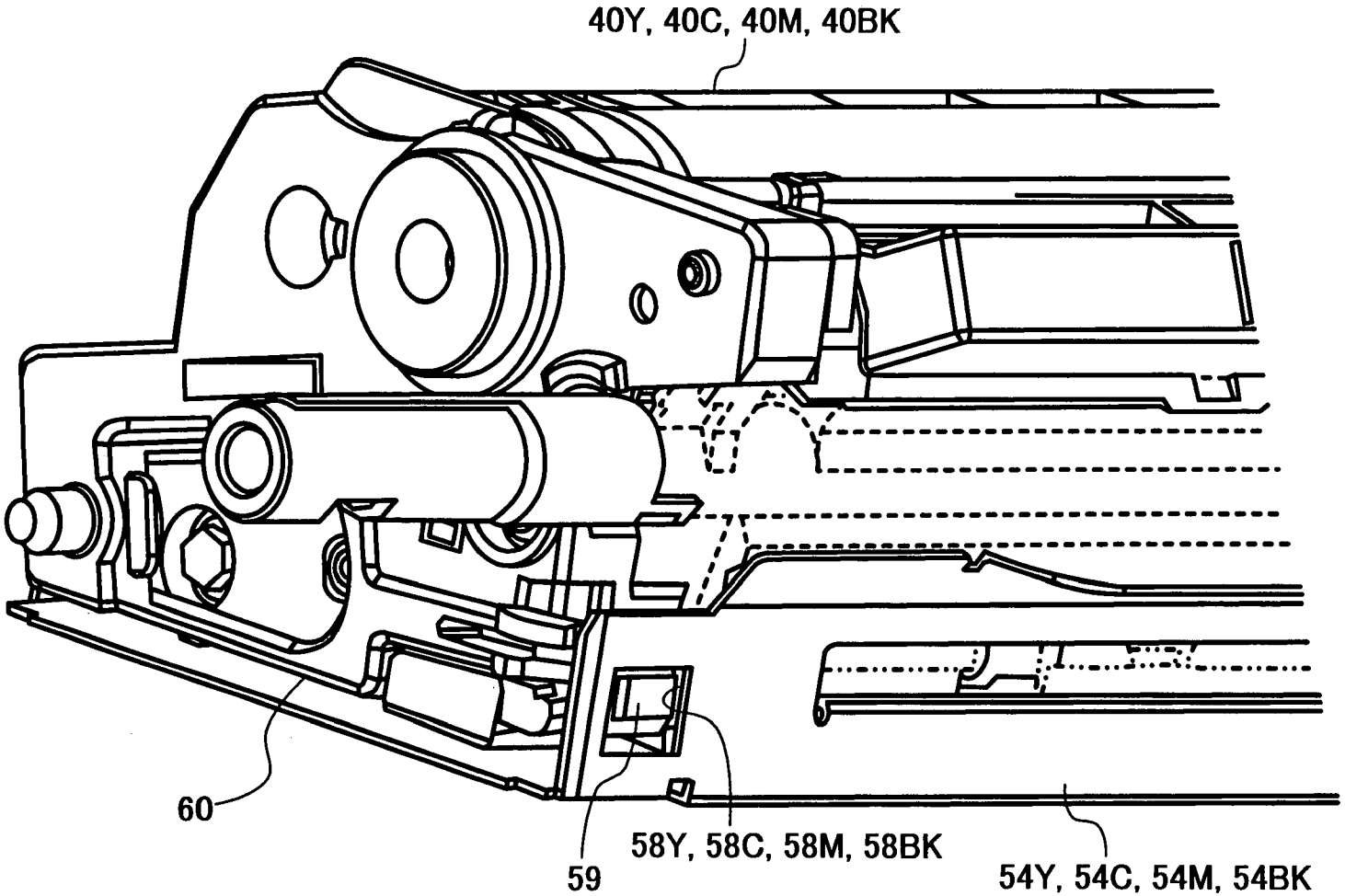
FIG. 8 is a fragmentary isometric view showing the process cartridge in the same condition as FIG. 7.
Figure 9:
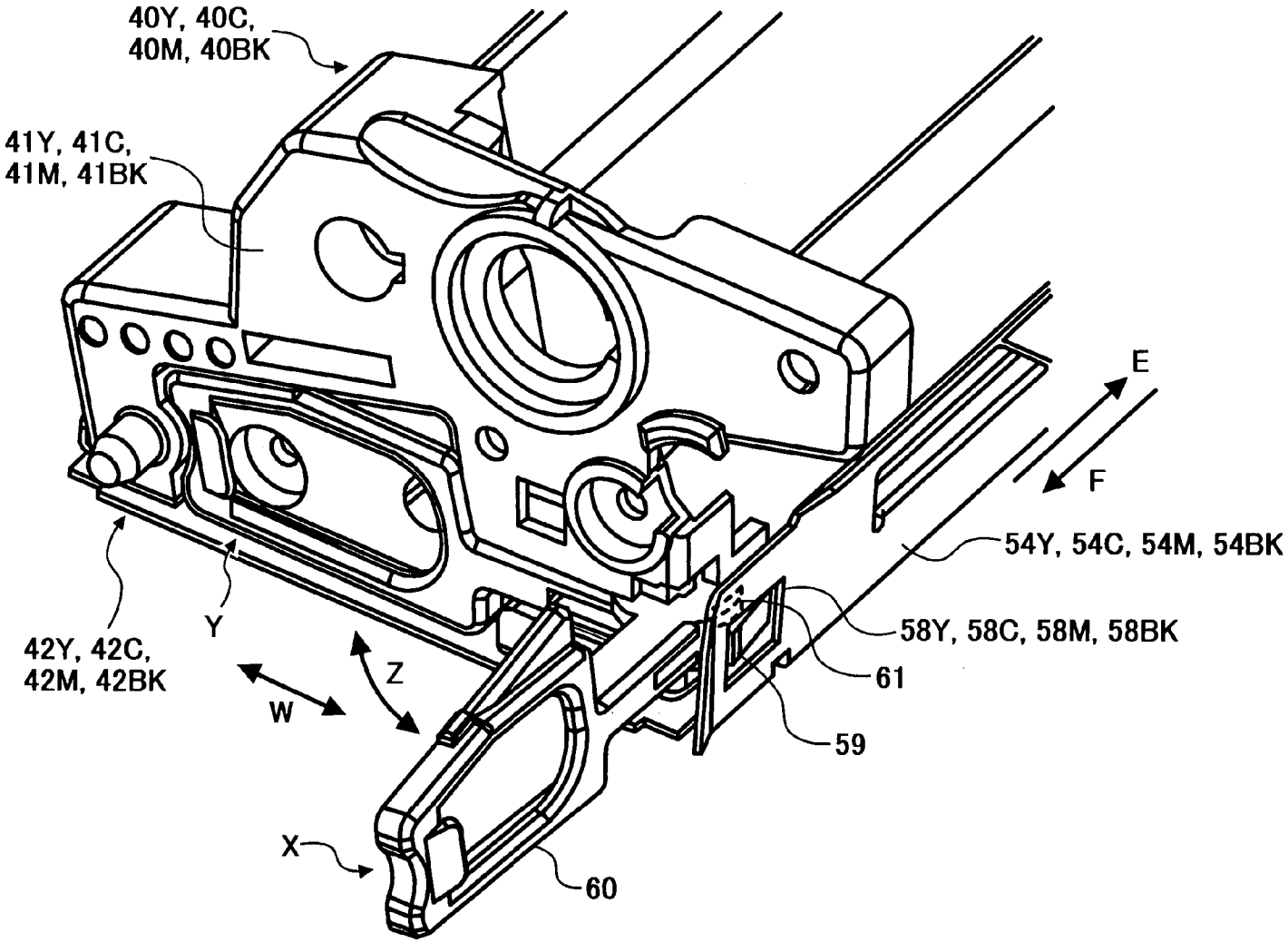
FIG. 9 is an isometric view demonstrating the movement of a handle.

When any one of the process cartridges 40Y, 40C, 40M, and 40BK is inserted into the apparatus body 1, the process cartridge 40Y, 40C, 40M, and 40BK must be accurately positioned at a preselected position. For this purpose, as shown in FIGS. 4, 5, 8 and 9, the stop plates 54Y, 54C, 54M, and 54BK are respectively formed with positioning holes 58Y, 58C, 58M, and 58BK in their front portions. On the other hand, as shown in FIGS. 6, 8 and 9, the process cartridges 40Y, 40C, 40M, and 40BK each are formed with a reference projection or reference portion 59 in its front portion.

As shown in FIGS. 8 and 9, when any one of the process cartridges 40Y, 40C, 40M, and 40BK is inserted to the deepest position of the apparatus body 1, the reference projection 59 of the process cartridge 40Y, 40C, 40M, and 40BK drops in associated one of the positioning holes 54Y, 54C, 54M, and 54BK due to its own weight. Consequently, the above process cartridge 40Y, 40C, 40M, and 40BK is positioned in the lengthwise position LL. At the same time, a compression spring or similar biasing means, not shown, biases the process cartridge 40Y, 40C, 40M, and 40BK thus positioned in the apparatus body 1 from the rear end of the apparatus body 1, locking the process cartridge 40Y, 40C, 40M, and 40BK in the position in the direction LL.

Alternatively, to fully position each process cartridge 40Y, 40C, 40M, and 40BK, a faceplate, not shown, may by mounted on the apparatus body 1 and brought to a closed position. Further, a pin may be studded on the rear end of each process cartridge 40Y, 40C, 40M, and 40BK and caused to mate with a positioning hole 58Y, 58C, 58M, and 58BK formed in the rear wall of the apparatus body 1, although not shown specifically.

To dismount any one of the process cartridges 40Y, 40C, 40M, and 40BK from the apparatus body 1, it suffices to pull the reference projection 59 of the process cartridge 40Y, 40C, 40M, and 40BK out of associated one of the positioning holes 58Y, 58C, 58M, and 58BK so as to unlock the process cartridge 40Y, 40C, 40M, and 40BK from the apparatus body 1 in the lengthwise direction LL and then pull the process cartridge 40Y, 40C, 40M, and 40BK out of the apparatus body 1. In this case, the process cartridge 40Y, 40C, 40M, and 40BK should advantageously be unlocked from the apparatus body 1 by the following configuration.

Figure 7:
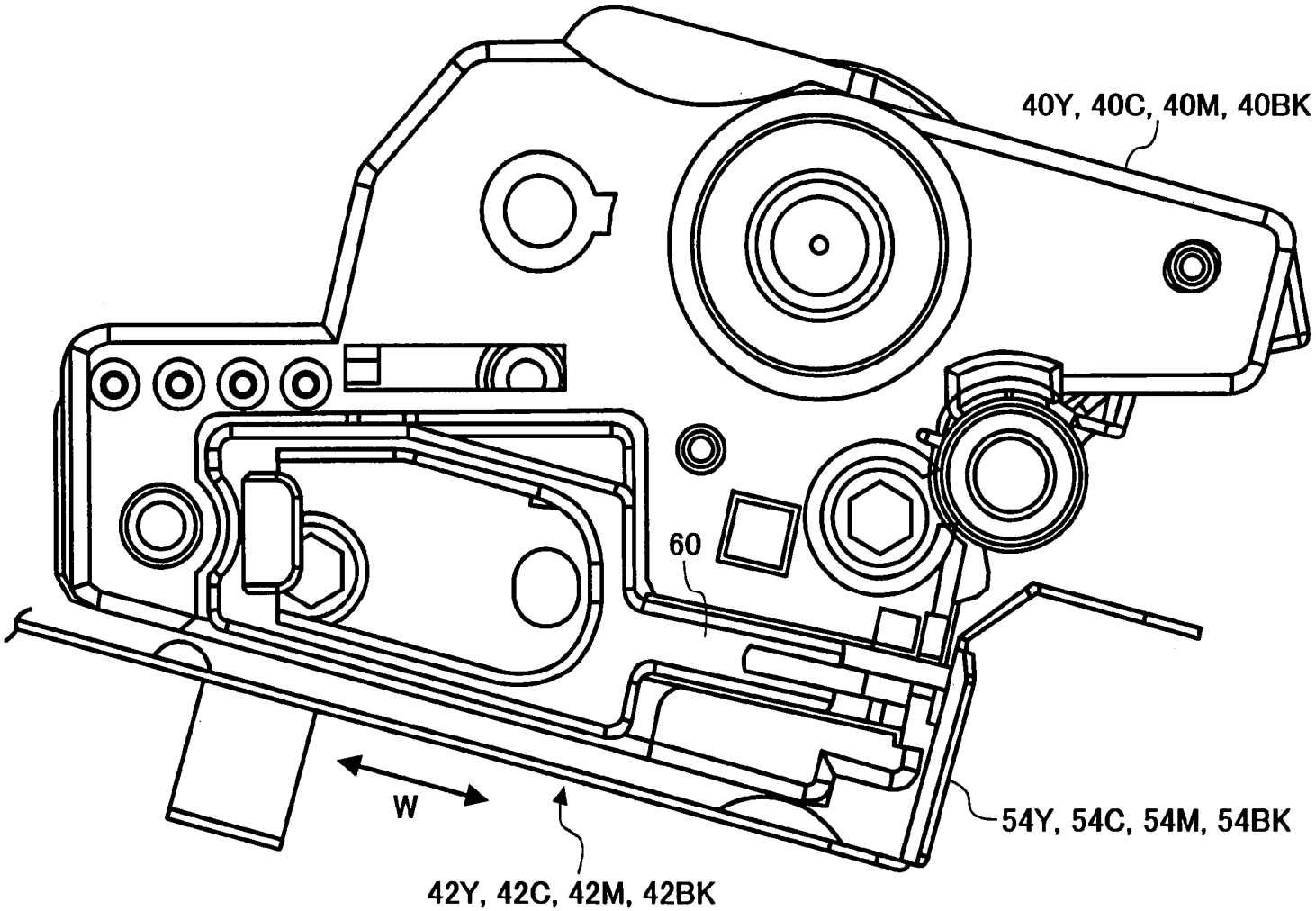
FIG. 7 is a front view showing the process cartridge mounted to the apparatus body.

As shown in FIGS. 6 through 9, a handle 60 is affixed to the front portion of each of the unit cases 41Y, 41C, 41M, and 41BK. The handle 60 is angularly movable between a use position X and a non-use or store position Y in a direction indicated by a double-headed arrow Z. FIGS. 6, 7 and 8 show the handle 60 stored in the non-use position.

When the process cartridges 40Y, 40C, 40M, and 40BK are mounted to the apparatus body 1, their handles 60 each are held in the non-use position. To remove any one of the process cartridges 40Y, 40C, 40M, and 40BK from the apparatus body 1, the handle 60 of the process cartridge 40Y, 40C, 40M, and 40BK is turned to the use position X, FIG. 9, by hand. Consequently, a cam portion 61, formed at the base end of the handle 60, abuts against and presses the wall of associated one of the stop plates 54Y, 54C, 54M, and 54BK, so that the process cartridge 40Y, 40C, 40M, and 40BK is slightly moved away from the stop plate 54Y, 54C, 54M, and 54BK by the reaction of the stop plate 54Y, 54C, 54M, and 54BK. As a result, the reference projection 59 gets out of associated one of the positioning holes 58Y, 58C, 58M, and 58BK. In this condition, the process cartridge 40Y, 40C, 40M, and 40BK can be pulled out of the apparatus body 1 forward with the handle 60 thereof being held by hand.

The illustrative embodiment is configured to transfer toner images from the drums or image carriers 2Y, 2C, 2M, and 2BK to the belt or image transfer body 3 one above the other. The present invention is similarly applicable to an image forming apparatus of the type directly transferring toner images formed on image carriers to a recording medium one above the other. Further, the present invention is applicable even to an image forming apparatus including a single process cartridge.

In summary, it will be seen that the present invention provides an image forming apparatus capable of preventing toner from dropping via a hole assigned to a light beam and smearing an optical writing unit.

Various modifications will become possible for those skilled in the art after receiving the teachings of the present disclosure without departing from the scope thereof.

The invention claimed is:

1. An image forming apparatus comprising:

an apparatus body;

an image carrier on which a toner image is to be formed;

a cleaning device constructed integrally with said image carrier and including a cleaning member configured to remove a residual toner left on said image carrier after transfer of the toner image; and at least one process cartridge removably mounted on said apparatus body and including a case bottom wall formed with a hole that allows a light beam emitted from an optical writing unit to be incident on said image carrier therethrough;

wherein when said process cartridge is mounted on said apparatus body, said hole is positioned in a portion of said case bottom wall positioned at a higher level than a portion of said case bottom wall below said cleaning member.

2. The apparatus as claimed in claim 1, wherein said cleaning device includes toner conveying means for conveying the toner removed from said image carrier by said cleaning member to an outside of said cleaning device, and said conveying means is positioned at a lower level than an axis of said image carrier.

3. The apparatus as claimed in claim 1, wherein said process cartridge includes a developing device for forming the toner image on said image carrier and positioned on an opposite side to said cleaning device with respect to said image carrier.

4. The apparatus as claimed in claim 3, wherein said developing device includes a developing roller for conveying a developer deposited thereon, and said developing roller is rotated in a direction for conveying a developer upward as viewed at a position where said developing roller faces said image carrier.

5. The apparatus as claimed in claim 3, wherein said process cartridge comprises a plurality of process cartridges arranged side by side and inclined relative to a horizontal plane, and at least part of said cleaning device included in an upper one of said plurality of process cartridges is positioned above said developing device of a lower one of said plurality of process cartridges and next to said upper one.

6. The device as claimed in claim 3, wherein said process cartridge comprises a plurality of process cartridges arranged side by side and inclined relative to a horizontal plane, said plurality of process cartridges each include a lubricant coating device for coating a lubricant on an associated one of said image carriers, and at least part of said lubricant coating device of an upper one of said plurality of process cartridges is positioned above said developing device of a lower one of said plurality of process cartridges.

7. The apparatus as claimed in claim 6, wherein a lubricant included in said lubricant coating device is substantially coincident in life with the other constituents of said process cartridge.

* * * * *